US011152715B2

(12) United States Patent
Isom et al.

(10) Patent No.: US 11,152,715 B2
(45) Date of Patent: Oct. 19, 2021

(54) DUAL DIFFERENTIAL RADIATOR

(71) Applicant: Raytheon Company, Waltham, MA (US)

(72) Inventors: Robert S. Isom, Allen, TX (US); David D. Crouch, Eastvale, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/793,592

(22) Filed: Feb. 18, 2020

(65) Prior Publication Data

US 2021/0257746 A1 Aug. 19, 2021

(51) Int. Cl.

| | |
|---|---|
| ***H01Q 21/26*** | (2006.01) |
| ***H01Q 21/06*** | (2006.01) |
| *H01Q 21/22* | (2006.01) |
| *H01Q 9/04* | (2006.01) |
| *H01Q 1/38* | (2006.01) |
| *H01Q 1/48* | (2006.01) |
| *H01Q 21/28* | (2006.01) |
| *H01Q 21/00* | (2006.01) |
| *H01Q 1/42* | (2006.01) |

(52) U.S. Cl.

CPC ..... *H01Q 21/062* (2013.01); *H01Q 21/26* (2013.01); *H01Q 1/38* (2013.01); *H01Q 1/42* (2013.01); *H01Q 1/48* (2013.01); *H01Q 9/0428* (2013.01); *H01Q 21/0025* (2013.01); *H01Q 21/22* (2013.01); *H01Q 21/28* (2013.01)

(58) Field of Classification Search

CPC ..... H01Q 21/062; H01Q 1/38; H01Q 21/28; H01Q 9/0428; H01Q 1/48; H01Q 21/22; H01Q 1/42; H01Q 21/0025; H01Q 21/26

See application file for complete search history.

(56) References Cited

U.S. PATENT DOCUMENTS

| | | | |
|---|---|---|---|
| 5,822,477 | A | 10/1998 | Crouch |
| 5,923,299 | A | 7/1999 | Brown et al. |
| 6,064,154 | A | 5/2000 | Crouch et al. |
| 6,107,901 | A | 8/2000 | Crouch et al. |
| 6,118,358 | A | 9/2000 | Crouch |
| 6,157,349 | A | 12/2000 | Crouch |
| 6,211,837 | B1 | 4/2001 | Crouch et al. |
| 6,259,208 | B1 | 7/2001 | Crouch |

(Continued)

FOREIGN PATENT DOCUMENTS

| | | |
|---|---|---|
| WO | WO 2016/138267 A1 | 9/2016 |
| WO | WO 2018/111387 A1 | 6/2018 |
| WO | WO 2018/111389 A1 | 6/2018 |

OTHER PUBLICATIONS

U.S. Appl. No. 14/999,923, filed Dec. 16, 2016, Sikina et al.

(Continued)

*Primary Examiner* — Joseph J Lauture

(74) *Attorney, Agent, or Firm* — Daly, Crowley, Mofford & Durkee, LLP

(57) ABSTRACT

Methods and apparatus for providing a wideband dual differential current loop radiator. In embodiments, a radiator includes first and second dipole pairs with first and second differential conductor pairs providing differential signals to the first and second dipole arms. The radiator may include a cavity, which can be filed with air, in at least a portion of a feed layer. The dipoles may have a coincident phase center.

19 Claims, 11 Drawing Sheets

(56) References Cited

U.S. PATENT DOCUMENTS

| | | | |
|---|---|---|---|
| 6,411,174 | B1 | 6/2002 | Crouch et al. |
| 6,522,226 | B2 | 2/2003 | Crouch et al. |
| 6,580,561 | B2 | 6/2003 | Crouch et al. |
| 6,693,605 | B1 | 2/2004 | Crouch et al. |
| 6,768,468 | B2 | 7/2004 | Crouch et al. |
| 6,864,857 | B2 | 3/2005 | Crouch et al. |
| 7,019,640 | B2 | 3/2006 | Canich et al. |
| 7,209,080 | B2 | 4/2007 | Crouch et al. |
| 7,504,982 | B2 | 3/2009 | Berg et al. |
| 7,538,735 | B2 | 5/2009 | Crouch |
| 7,545,570 | B2 | 6/2009 | Crouch |
| 7,688,265 | B2 | 3/2010 | Irion, II et al. |
| 7,800,538 | B2 | 9/2010 | Crouch et al. |
| 7,812,263 | B2 | 10/2010 | Crouch et al. |
| 7,948,441 | B2 | 5/2011 | Irion, II et al. |
| 8,072,380 | B2 | 12/2011 | Crouch |
| 8,081,115 | B2 | 12/2011 | Crouch et al. |
| 8,125,402 | B2 | 2/2012 | Crouch et al. |
| 8,134,494 | B1 | 3/2012 | Isom et al. |
| 8,134,510 | B2 | 3/2012 | Crouch et al. |
| 8,149,179 | B2 | 4/2012 | Crouch |
| 8,178,792 | B2 | 5/2012 | Crouch et al. |
| 8,259,027 | B2 | 9/2012 | Isom et al. |
| 8,427,382 | B2 | 4/2013 | Crouch |
| 8,681,064 | B2 | 3/2014 | Isom |
| 8,767,192 | B2 | 7/2014 | Crouch |
| 9,130,252 | B2 | 9/2015 | Isom et al. |
| 9,172,140 | B2 | 10/2015 | Crouch et al. |
| 9,397,400 | B2 | 7/2016 | Crouch et al. |
| 9,402,301 | B2 | 7/2016 | Paine et al. |
| 9,437,929 | B2 | 9/2016 | Isom et al. |
| 9,468,103 | B2 | 10/2016 | Isom et al. |
| 9,500,446 | B2 | 11/2016 | Crouch et al. |
| 9,537,208 | B2 | 1/2017 | Isom |
| 9,774,069 | B2 | 9/2017 | Crouch |
| 9,780,458 | B2 | 10/2017 | Viscarra et al. |
| 9,819,068 | B2 | 11/2017 | Kocurek et al. |
| 9,876,279 | B2 | 1/2018 | Crouch et al. |
| 10,063,264 | B2 | 8/2018 | Crouch et al. |
| 10,153,536 | B2 | 12/2018 | Gritters et al. |
| 10,153,547 | B2 | 12/2018 | Crouch |
| 10,236,588 | B2 | 3/2019 | Crouch |
| 10,361,485 | B2 | 7/2019 | Isom |
| 10,424,847 | B2 | 9/2019 | Isom et al. |
| 10,495,492 | B2 | 12/2019 | Sar et al. |
| 2012/0146869 | A1 | 6/2012 | Holland et al. |
| 2013/0106649 | A1 | 5/2013 | Brown et al. |
| 2018/0048065 | A1* | 2/2018 | Zimmerman ..... H01Q 1/246 |
| 2018/0175512 | A1* | 6/2018 | Isom ..... H01Q 1/405 |
| 2018/0175513 | A1 | 6/2018 | Isom et al. |
| 2019/0140364 | A1* | 5/2019 | Mirmozafari ..... H01Q 21/24 |
| 2019/0356058 | A1 | 11/2019 | Martin et al. |

OTHER PUBLICATIONS

U.S. Appl. No. 16/659,985, filed Dec. 22, 2019, Crouch et al.
PCT International Search Report and Written Opinion dated Feb. 10, 2021 for International Application No. PCT/US2020/060652; 15 Pages.

* cited by examiner

DUAL DIFFERENTIAL RADIATOR

BACKGROUND

As is known in the art, a plurality of antenna elements can be disposed to form an array antenna. It is often desirable to utilize antenna elements capable of receiving orthogonally polarized radio frequency (RF) signals. Such antenna elements include, for example, four arm, dual polarized current sheet antenna elements such as tightly coupled dipole array (TCDA), planar ultrawideband modular antenna (PUMA), and other known current sheet radiators. These radiator elements rely on polarization-aligned coupling to maintain their polarization scan performance over the scan volume, particularly at large scan angles. Patch radiators may also be used and are low cost and easy to integrate, but suffer from poor circularly polarized performance over scan.

Conventional PUMA, TCDA, and current loop radiators may not achieve certain desired performance characteristics. For example, PUMA radiators are low profile compared to other types of radiators, but are not coincident phase-centered elements. TCDAs may be relatively costly and are not as low profile as desired. Known current loop radiators are typically single ended and do not provide coincident phase-centered elements.

SUMMARY

Embodiments of the invention provide methods and apparatus for a dual differential radiator that is low profile, low loss, and coincident phase centered, with desirable cross-polarization performance. In embodiments, a dual differential radiator is integrated into a PWB solution covering multiple frequency bands that can be packaged into a tile solution having a high interconnect density. Embodiments can eliminate the need for additional baluns, which enhances loss characteristics and system figures of merit.

In embodiments, a differential current loop radiator provides a wideband millimeter-wave radiator. In embodiments, a low-profile radiator covers a wide bandwidth, e.g., 18-50 GHz. In some embodiments, a low profile is provided by a total depth (0.1") of 0.43 wavelength at 50 GHz (0.155 wavelength at 18 GHz) that includes the radiator and a wide-angle impedance matching structure above the radiator. In embodiments, the radiator provides low loss and broad, e.g., 60 degree, scan coverage, while maintaining exceptional cross-polarization performance. Radiators also achieve coincident phase centers at the element level in contrast to conventional current loop radiators.

In some embodiments, a dual-differential architecture and symmetric balanced feed pairs eliminate the need for symmetry-destroying baluns and feed circuitry from the radiator itself thereby improving cross-polarization performance. In addition, embodiments of a radiator eliminate shorting vias from formerly undriven dipole arms, yielding balanced dipole pairs. Further, wide-angle impedance matching layers may be integrated as a low cost support structures to improve loss performance over scan. Some embodiments of a radiator include an air-filled cylindrical cavity built in the printed wiring board (PWB) directly beneath the radiator circuit feed for reducing the dielectric constant and improving performance. Embodiments of a radiator can include a radiator grounding structure having a ground plane, a ground plate beneath each dipole arm coupled to the ground plane, and a floating second capacitive-coupled plate above each dipole arm.

In one aspect, a current loop radiator comprises: a first dipole pair comprising first and second dipole arms; a second dipole pair comprising third and fourth dipole arms; a first differential conductor pair having first and second conductors configured to provide a first pair of differential signals to the first and second dipole arms; and a second differential conductor pair having third and fourth conductors configured to provide a second pair of differential signals to the third and fourth dipole arms.

A radiator can further include one or more of the following features: respective conductive plates capacitively coupled with each of the first, second, third, and fourth dipole arms, respective ground plates adjacent each of the first, second, third and fourth dipole arms, a radiator layer includes the first, second, third, and fourth dipole arms, the conductive plates and the ground plates, a feed layer is adjacent the radiator layer, wherein the first and second conductors of the first differential conductor pair extend from the feed layer to the first and second dipole arms, the first and second conductors of the first differential conductor pair comprise vias, the third and fourth conductors of the second differential conductor pair comprise vias, a cavity formed in at least a portion of the feed layer, the cavity is cylindrical and filled with air, the cavity is below the first, second, third and fourth conductors, a wide-angle impedance matching (WAIM) layer disposed on the radiator over the first and second dipole pairs, the radiator and the WAIM layer together have a total depth of less 0.1 inch at 50 GHz, the first, second, third, and fourth dipole arms have a coincident phase center, and/or the radiator consists of printed wiring board (PWB) materials.

In another aspect, a method comprises: employing a first dipole pair comprising first and second dipole arms; employing a second dipole pair comprising third and fourth dipole arms; employing a first differential conductor pair having first and second conductors for providing a first pair of differential signals to the first and second dipole arms; and employing a second differential conductor pair having third and fourth conductors for providing a second pair of differential signals to the third and fourth dipole arms.

A method can further include employing one or more of the following features: respective conductive plates capacitively coupled with each of the first, second, third, and fourth dipole arms, respective ground plates adjacent each of the first, second, third and fourth dipole arms, a radiator layer includes the first, second, third, and fourth dipole arms, the conductive plates and the ground plates, a feed layer is adjacent the radiator layer, wherein the first and second conductors of the first differential conductor pair extend from the feed layer to the first and second dipole arms, the first and second conductors of the first differential conductor pair comprise vias, the third and fourth conductors of the second differential conductor pair comprise vias, a cavity formed in at least a portion of the feed layer, the cavity is cylindrical and filled with air, the cavity is below the first, second, third and fourth conductors, a wide-angle impedance matching (WAIM) layer disposed on the radiator over the first and second dipole pairs, the radiator and the WAIM layer together have a total depth of less 0.1 inch at 50 GHz, the first, second, third, and fourth dipole arms have a coincident phase center, and/or the radiator consists of printed wiring board (PWB) materials.

In a further aspect, a current loop radiator comprises: a signal receiving means for receiving signals via an air interface; a first differential conductor means for providing a first pair of differential signals to the signal receiving means; and a second differential conductor means for providing a second pair of differential signals to the signal receiving means.

BRIEF DESCRIPTION OF THE DRAWINGS

The foregoing features of this invention, as well as the invention itself, may be more fully understood from the following description of the drawings in which.

DETAILED DESCRIPTION

Figure 1A:
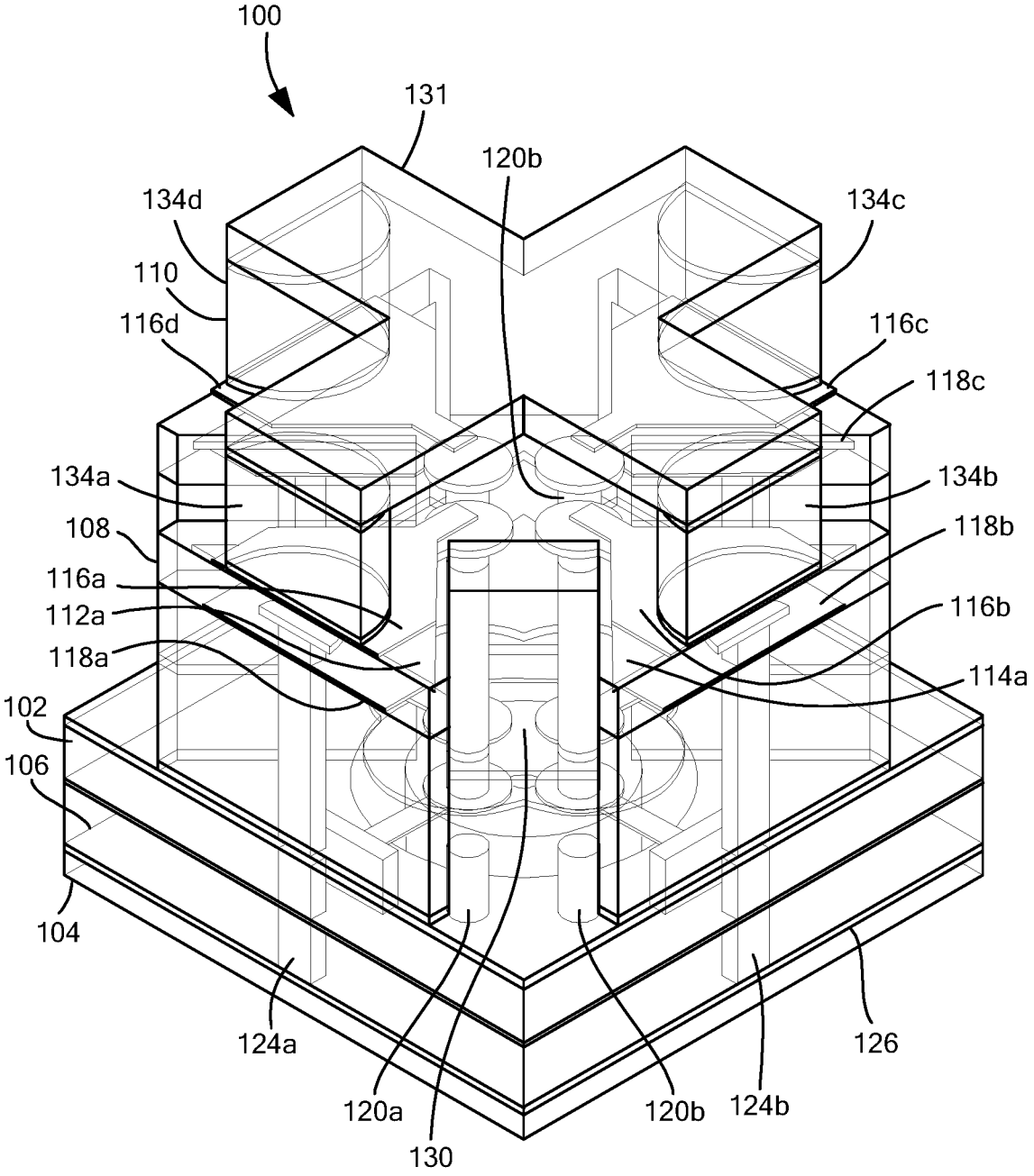
FIG. 1A is a partially transparent perspective view.

Described herein are concepts, systems, circuits and related techniques directed toward a wideband differential antenna element (or radiator) and toward array antennas provided from such radiators.

Before describing the various embodiments of a wideband differential radiator, it should be noted that reference is sometimes made herein to an array antenna having a particular array shape and/or size (e.g., a particular number of antenna elements) or to an array antenna comprised of a particular number of antenna elements. One of ordinary skill in the art will appreciate, however, that the concepts, circuits and techniques described herein are applicable to various sizes, shapes and types of array antennas.

Thus, although the description provided herein below describes the concepts, systems and circuits sought to be protected in the context of a wideband differential array antenna having a substantially square or rectangular shape and comprised of a elements, each having a substantially square or rectangular-shape, those of ordinary skill in the art will appreciate that the concepts equally apply to other sizes and shapes of array antennas and antenna elements having a variety of different sizes, shapes.

Reference is also sometimes made herein to an array antenna including an antenna element of a particular type, size and/or shape configured for operation at certain frequencies. Those of ordinary skill in the art will recognize, of course, that other antenna shapes may also be used and that the size of one or more antenna elements may be selected for operation at any frequency in the RF frequency range.

It should also be appreciated that the antenna elements can be provided having any one of a plurality of different antenna element lattice arrangements including periodic lattice arrangements (or configurations) such as rectangular, circular square, triangular (e.g. equilateral or isosceles triangular), and spiral configurations as well as non-periodic or other geometric arrangements including arbitrarily shaped lattice arrangements.

While relative terms, such as "vertical," "above," "lower," "upper," "left," "right," and the like, may be used to facilitate an understanding of example embodiments, such terms are not to limit the scope of the claimed invention in any way. These terms, and any similar relative terms, are not to construed as limiting in any way, but rather, as terms of convenience in describing embodiments of the invention.

Applications of at least some embodiments of the concepts, systems, circuits and techniques described herein include, but are not limited to, military and non-military (i.e. commercial) applications including, but not limited to radar, electronic warfare (EW) and communication systems for a wide variety of applications including ship-based, airborne (e.g. plane, missile or unmanned aerial vehicle (UAV)), and space and satellite applications. It should thus be appreciated that the circuits described herein can be used as part of a radar system or a communications system.

Figure 1C:
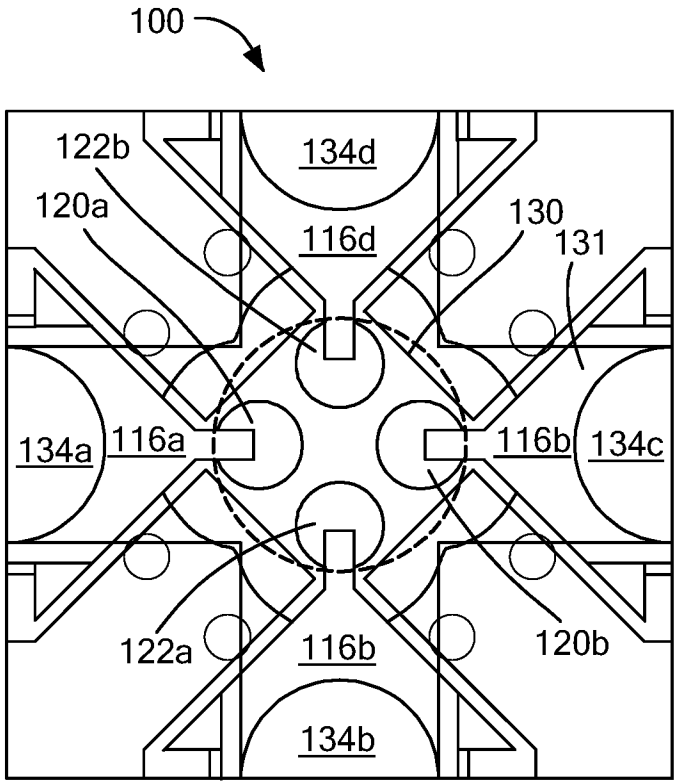
FIG. 1C is a partially transparent top view of a radiator in accordance with example embodiments of the invention.
Figure 1B:
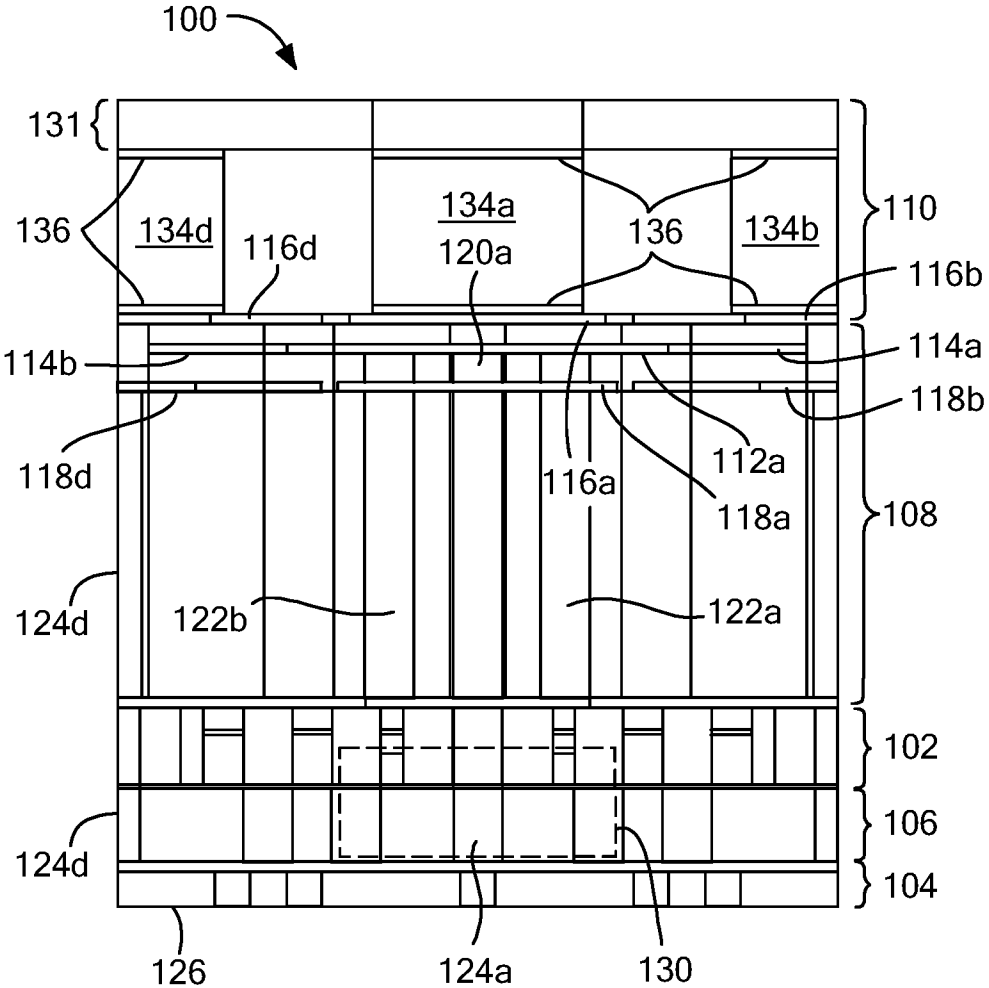
FIG. 1B is a partially transparent side view.

FIGS. 1A, 1B, and 1C show a unit cell of a wideband differential current loop radiator 100 in accordance with example embodiments of the invention where like reference numbers indicate like elements. A dual, differential architecture and symmetric balanced feed pairs eliminate the need for symmetry-breaking baluns and feed circuitry required by conventional loop radiators. By eliminating the baluns and feed circuitry, cross-polarization performance is enhanced.

A feed layer 102 is coupled to an interface layer 104, such as a solder ball layer. An optional layer structure 106 can be provided between the interface layer 104 and the feed layer 102, as described more fully below. In embodiments, the feed layer 102 comprises a stripline layer to provide desired connections. A radiator layer 108 is provided between the feed layer 102 and a wide-angle impedance matching (WAIM) layer 110.

The radiator layer 108 includes first and second dipole arms 112*a,b* that form a first dipole pair and third and fourth dipole arms 114*a,b* that form a second dipole pair, wherein each pair of dipole arms is driven with a pair of differential signals. A first conductive layer portion 116*a* is above the first dipole arm 112*a*, second conductive layer portion 116*b* is above the second dipole arm 112*b*, a third conductive layer portion 116*c* is above the third dipole arm 114*a*, and a fourth conductive layer portion 116*d* is above the fourth dipole arm 114*b*. In embodiments, the first, second, third, and fourth, conductive layer portions 116*a,b,c,d* are floating, e.g., not connected to ground, a voltage supply, or circuitry. The conductive layer portions 116*a,b,c,d* are capacitively coupled to the respective dipole arms 112*a,b*, 114*a,b*. In embodiments, the conductive layer portions 116 extend from an edge of the unit cell and after a length, taper to a center of the unit cell.

In embodiments, conductive layer portions 118*a-d*, which are connected to ground, are located 'under' the dipole arms 112*a,b* 114*a,b*. In the illustrated embodiment, a fifth conductive layer portion 118*a* is below the first dipole arm 112*a*, a sixth conductive layer portion 118*b* is below the second dipole arm 112*b*, a seventh conductive layer portion 118*c* is below the third dipole arm 114*a*, and an eighth conductive layer portion 118*d* is below the fourth dipole arm 114*b*. In embodiments, the fifth, sixth, seventh, and eighth conductive layer portions 118*a,b,c,d* are connected to ground.

It is understood that the conductive portions 116*a-d* above the dipole arms 112*a,b*, 114*a,b* and the conductive portions

118*a-d* below the dipole arms provide tuning of the dipole arm operating characteristics. This tuning extends the bandwidth performance and improves loss in the operating band.

In example embodiments, first and second signal conductors 120*a,b*, which can be referred to as vertical vias, extend from the feed layer 102/106 to the first and second dipole arms 112*a,b* of the first dipole pair and third and fourth signal conductors 122*a,b* extend from the feed layer to the third and fourth dipole arms 114*a,b* of the second dipole pair. The first and second signal conductors 120*a,b* provide differential signals to the dipoles 120*a,b* of the first dipole pair. Similarly, the third and fourth conductors 122*a,b* provide differential signals to the second dipole pair. With this arrangement, dual differential signals excite the first and second dipole pairs. In example embodiments, differential signals refer to a pair of signals that are one hundred and eighty degrees out of phase. By using the dual differential signals, a balun to transition balanced signals to unbalanced signals is not needed.

Figure 1D:
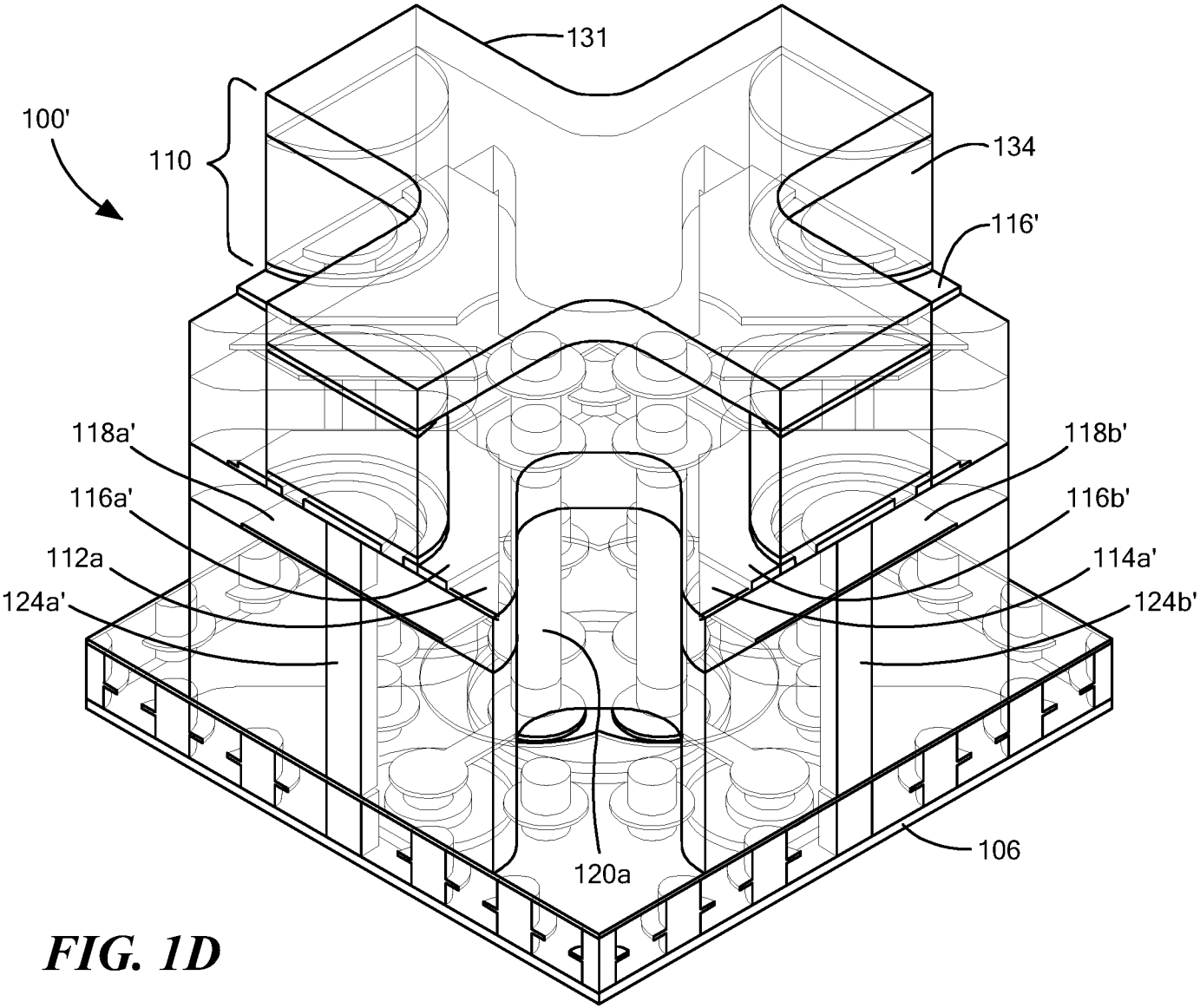
FIG. 1D is a partially transparent perspective view of another embodiment of a radiator in accordance with example embodiments of the invention.

In embodiments, the 'lower' conductive layers 118*a-d* are connected to a ground plane 126 and may connect to additional or all ground planes in the feed layer 102 layer structure 106 by respective vias 124*a-d*. As noted above, the 'lower' conductive layers 118*a-d* provide tuning for the radiator. FIG. 1D shows another embodiment of a radiator 100' in which the vias 124' extend from the ground planes 106 to the level of the conductive layers 116. The radiator 100' has a feed layer 102 with a six layer configuration.

In embodiments, the radiator 100 includes a cavity 130 that can be filled with air, for example, located below the vertical vias for the differential signals. In some embodiments, the PWB is backdrilled to remove PWB material to form the cavity. While the cavity 130 is shown as cylindrical in the illustrated embodiment, it is understood that the cavity can have any suitable geometry, such as ovular and the like. The cavity 130 enhances radiator bandwidth by reducing the effective dielectric constant. In other embodiments, the cavity can be filled, at least in part, with a suitable dielectric material. It will be appreciated that increasing the amount air in the cavity compared with conventional single ended radiators enhances performance of the radiator.

The WAIM layer 110 is positioned over the radiator layer 108 for enhancing radiator bandwidth and scan range. In embodiments, a dielectric layer 131 is positioned by a series of supports 134*a,b,c,d* that extend from the floating conductive layers 118*a-d*.

In example embodiments, the dielectric layer 131 comprises a high dielectric material, e.g., in the order of 10 for dielectric constant, such as a microwave composite laminate. Suitable materials are available from ROGERS CORPORATION, such as Rogers 6010. The supports 134 can be provided from suitable materials having a desirable and stable dielectric constant (Dk), e.g., in the order of 6, over temperature. Suitable materials include RO3006 from ROGERS CORPORATION.

In embodiments, the supports 134 have an interface material 136 for the dielectric material 103 and upper conductive layers 118. Example interface materials include suitable low-loss and low-dielectric constant, e.g., in the order of about 2-4, prepregs and adhesives, including Rogers 6250 and 6700, Rogers 2929, and adhesives commonly used in circuit card assembly (e.g., Ablebond adhesives).

In example embodiments, the radiating elements have coincident phase centers enabled by the dual differential feeds for the pairs of dipole arms 112*a,b*, 114*a,b*. In embodiments, each of the dipole arms are equally spaced about a common center.

In embodiments, the radiator, which may not include the WAIM layer, comprises conventional PWB materials and processing that enable the fabrication of low-cost wideband millimeter-wave radiators. Illustrative radiators have a low profile and cover a wide bandwidth, e.g., 18-50 GHz a low profile, for example a total depth (0.1") of 0.43 wavelength at 50 GHz (0.155 wavelength at 18 GHz) that includes the radiator and wide-angle impedance matching structure. It will be appreciated that radiator embodiments are readily scalable down to frequencies in the order of about 2 GHz and scalable up to V-band frequencies. Example radiator embodiments provide low loss and broad, e.g., 60 degree, scan coverage, while maintaining exceptional cross-polarization performance which may be enhanced by the symmetrical configuration enables by the dual differential feed structure. In addition, vias that may be required in conventional single ended feed signals are no longer required in example embodiments of a dual differential feed radiator.

As noted above, radiator embodiments may include a direct connection of the feed layer 102 to the interface layer 104, e.g., solder ball interface layer. In other embodiments, a further layer 106 may be provided between the interface layer 104 and the feed layer 102. The layer 106 can include any practical number of layers, e.g., 20 layers, can include additional features, such as active components, backside components, manifolds, CCAs, via, etc., to meet the needs of a particular application.

Figure 2A:
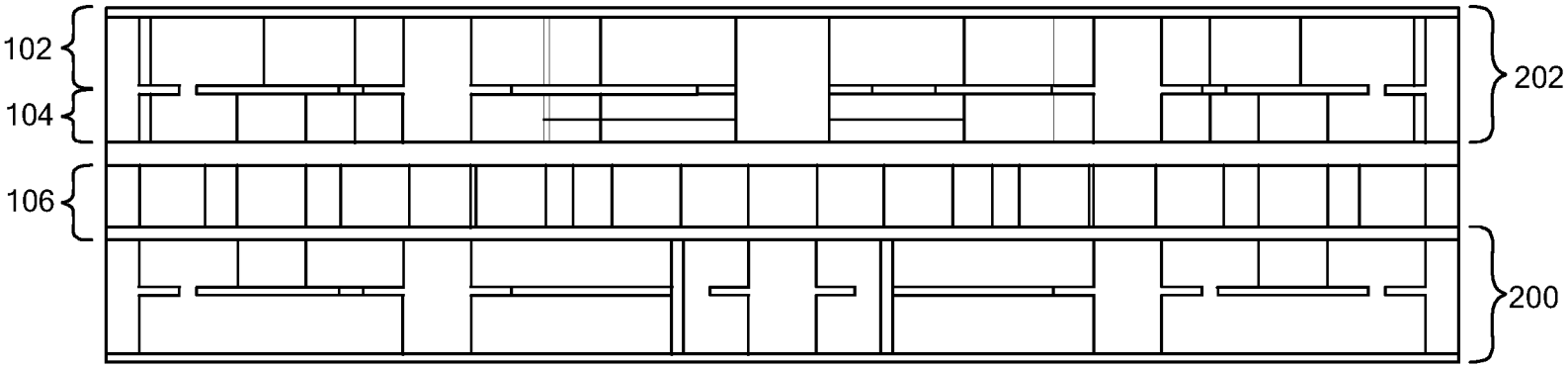
FIG. 2A is a cross-sectional view.
Figure 2B:
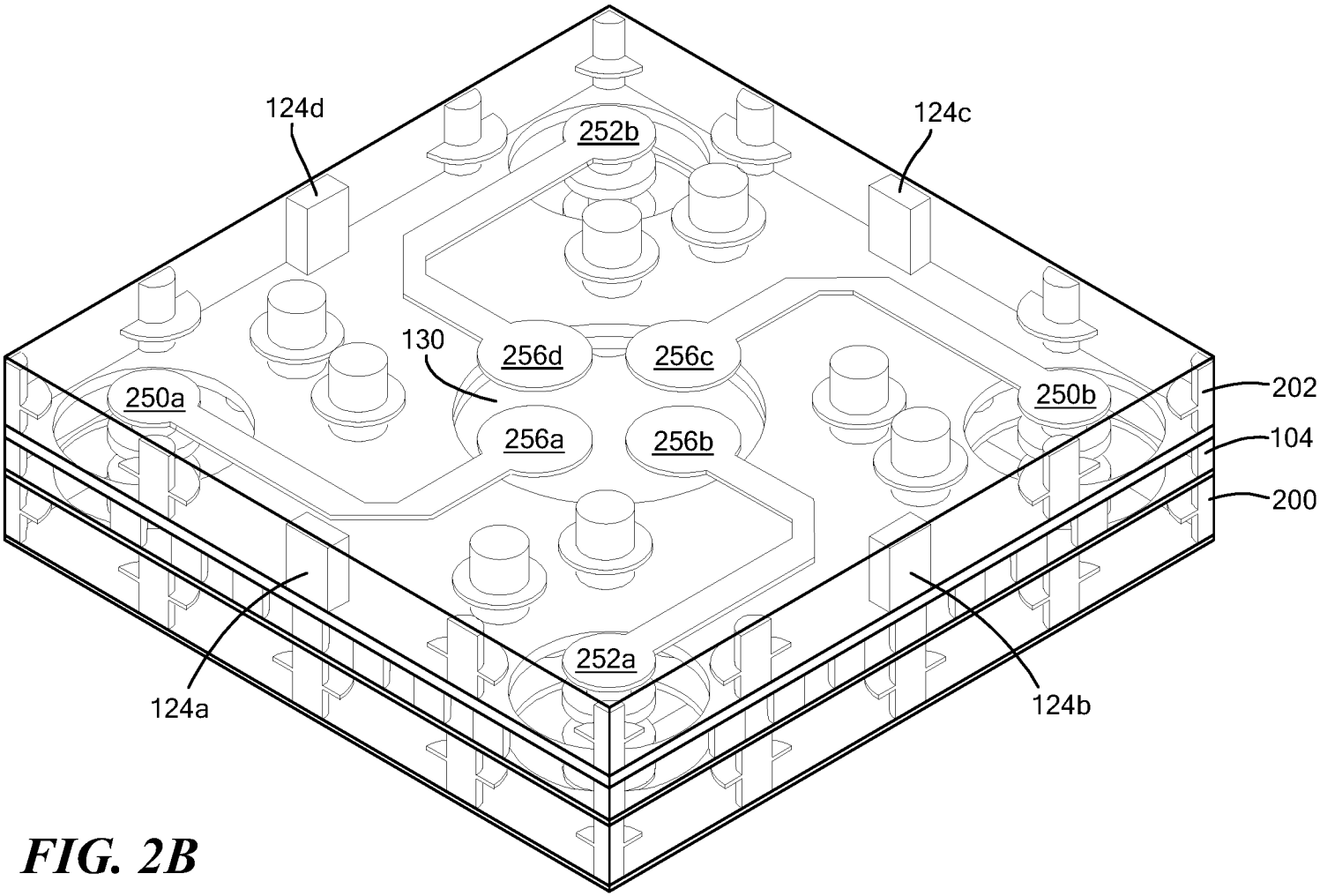
FIG. 2B is a partially transparent perspective view.
Figure 2C:
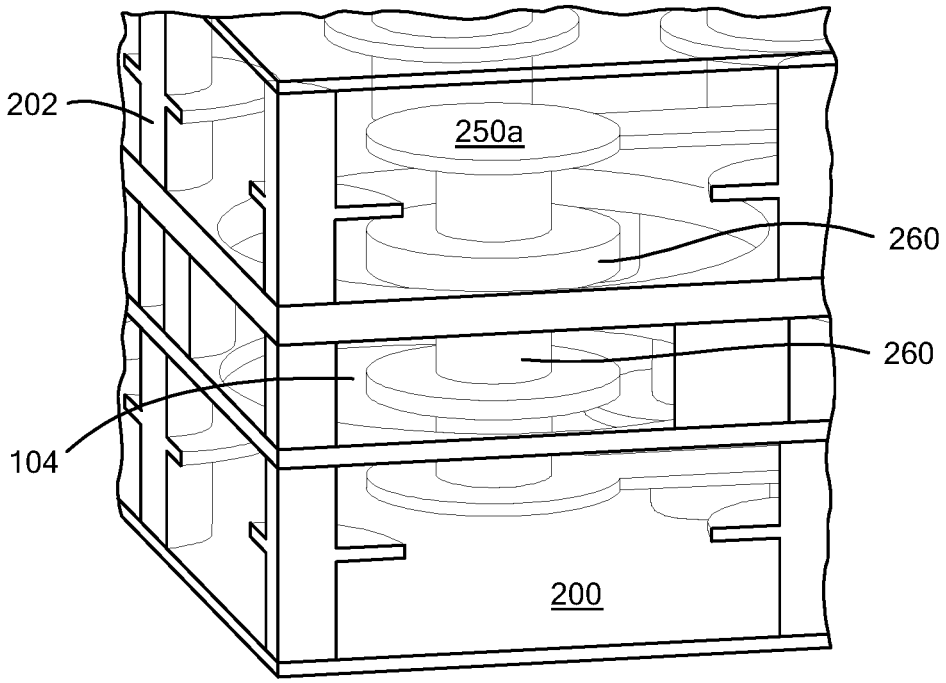
FIG. 2C is a partially transparent perspective view of a portion of the radiator of FIG. 1A.

FIGS. 2A-C show an example radiator portion coupled to an interposer 200. In the illustrated embodiment, the feed layer 102 and layer 106 provide a lower layer 202 coupled to the interposer 200 via the interface layer 104. Solder balls 204, for example, can connect the lower layer 202 and the interposer 200. In embodiments, the interposer 200 comprises a PWB assembly. In other embodiments, the interposer 200 is fabricated using other components and processes.

As best seen in FIG. 2B, first and second input pads 250*a,b* receive a differential pair of first and second signals to drive the first dipole pair 112*a,b* (FIG. 1A) and second and third input pads 252*a,b* receive a differential pair of third and fourth signals to drive the second dipole pair 114*a,b*. The differential signals can be received by the radiator at respective IOs connected to the interposer 200. For example, as best seen in FIG. 2C, the first input pad 250*a* can receive a signal at a first IO 260 from the interposer 200 via a solder ball 262 in the interface layer 104.

The first input pad 250*a* extends to a first inner pad 256*a* to which the first signal conductor 102*a* (FIG. 1A) can extend to the first dipole arm 112*a*. In a similar manner, the remaining signal conductors 120*b*, 122*a,b*, can extend from the other inner pads 256*b,c,d* to the respective dipole arm 112*b*, 114*a,b*.

Figure 2D:
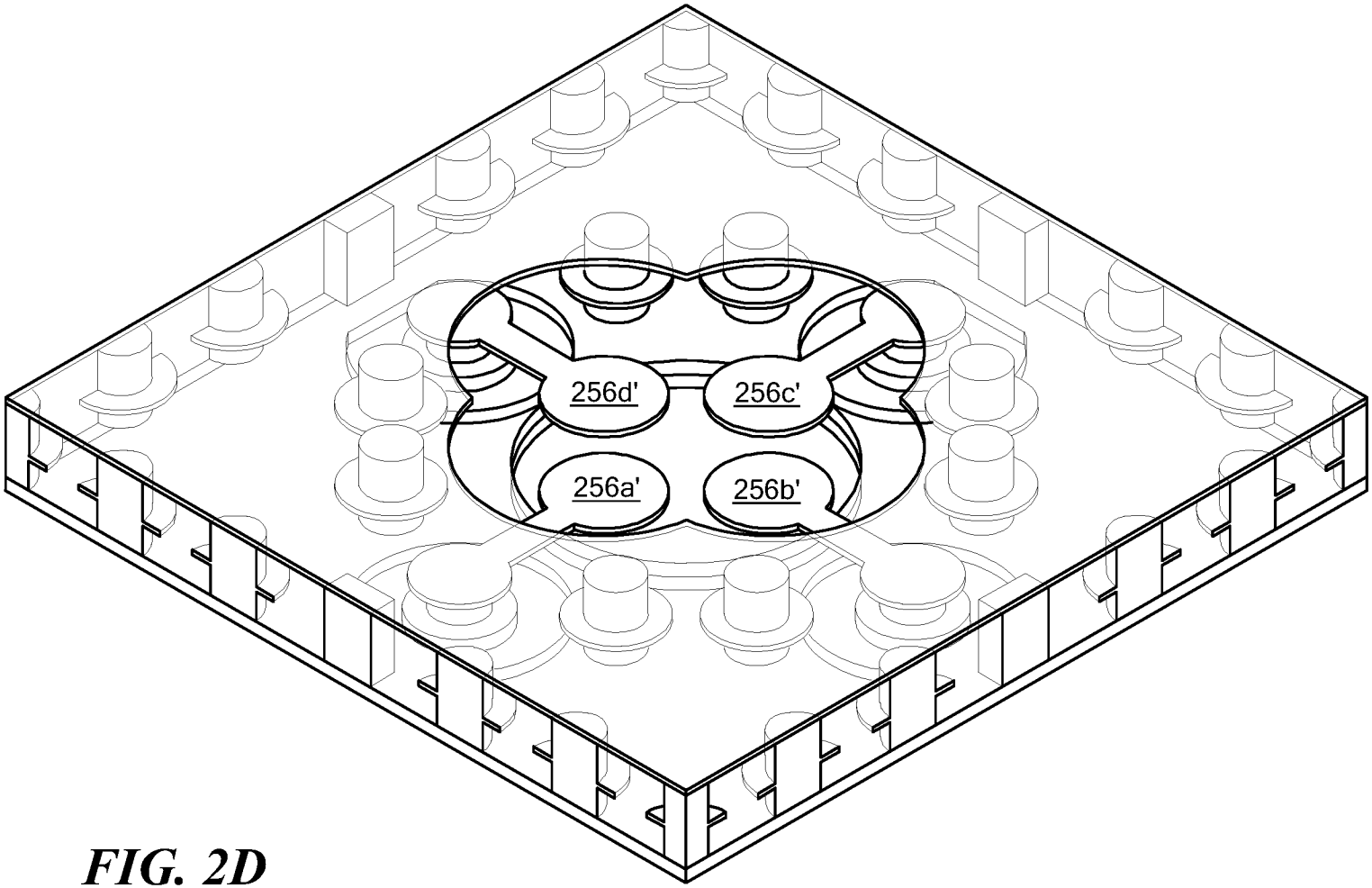
FIGS. 2D and 2E show alternative embodiment of a portion of the radiator of FIG. 1A.
Figure 2E:
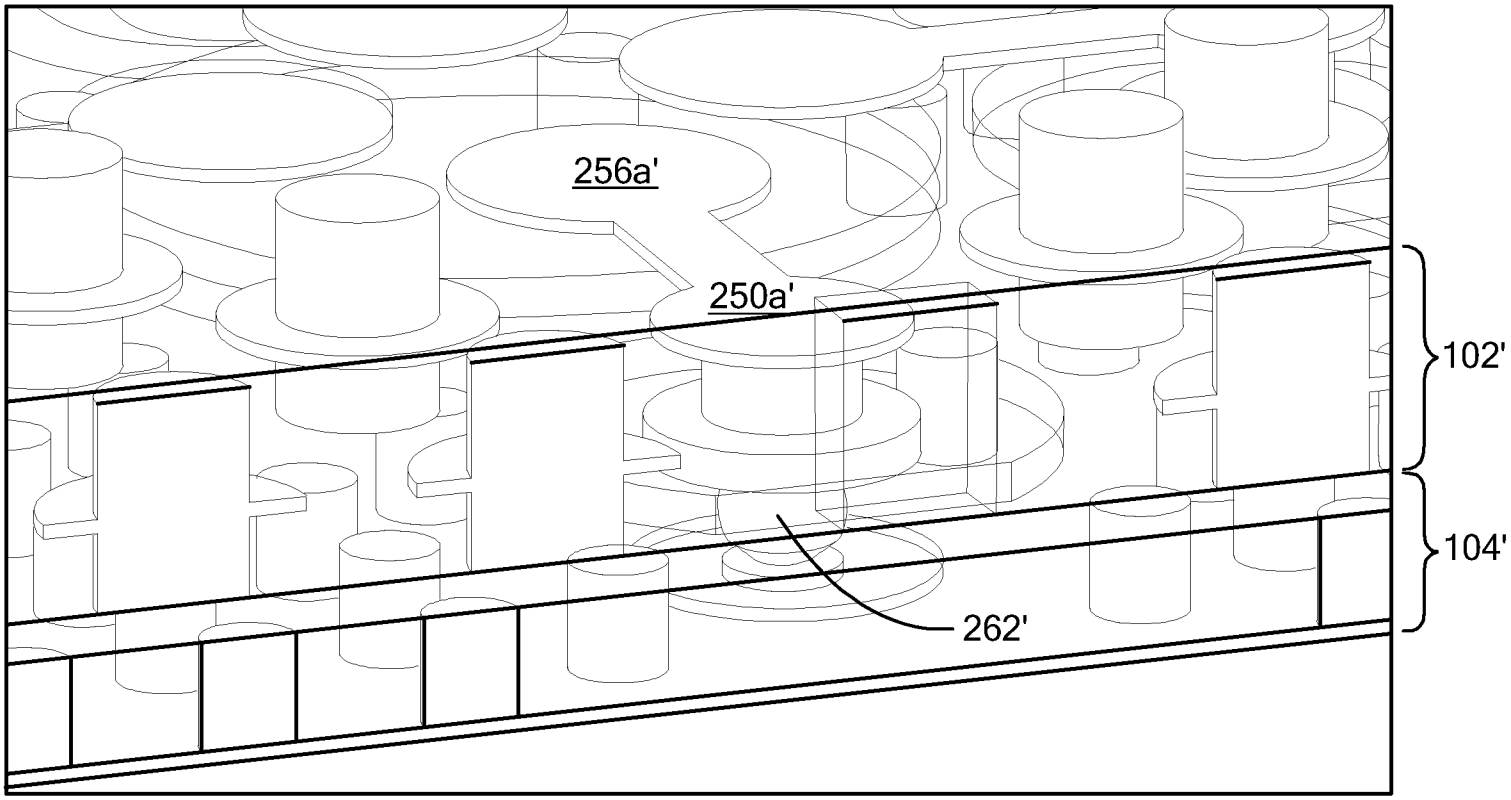

FIG. 2D shows another embodiment of pads 256*a*'-d' providing pairs of differential signals to the dipole arms. FIG. 2E shows the pad 256*a*' connected to an input pad 250*a*' disposed in a feed layer 102' connected to an interface layer 104'.

As best seen in FIG. 2B, first and second input pads 250*a,b* receive a differential pair of first and second signals to drive the first dipole pair 112*a,b* (FIG. 1A) and second and third input pads 252*a,b* receive a differential pair of third and fourth signals to drive the second dipole pair 114*a,b*. The differential signals can be received by the radiator at respective IOs connected to the interposer 200. For example, as best seen in FIG. 2C, the first input pad 250*a* can receive a signal at a first IO 260 from the interposer 200 via a solder ball 262 in the interface layer 104.

Figure 3:
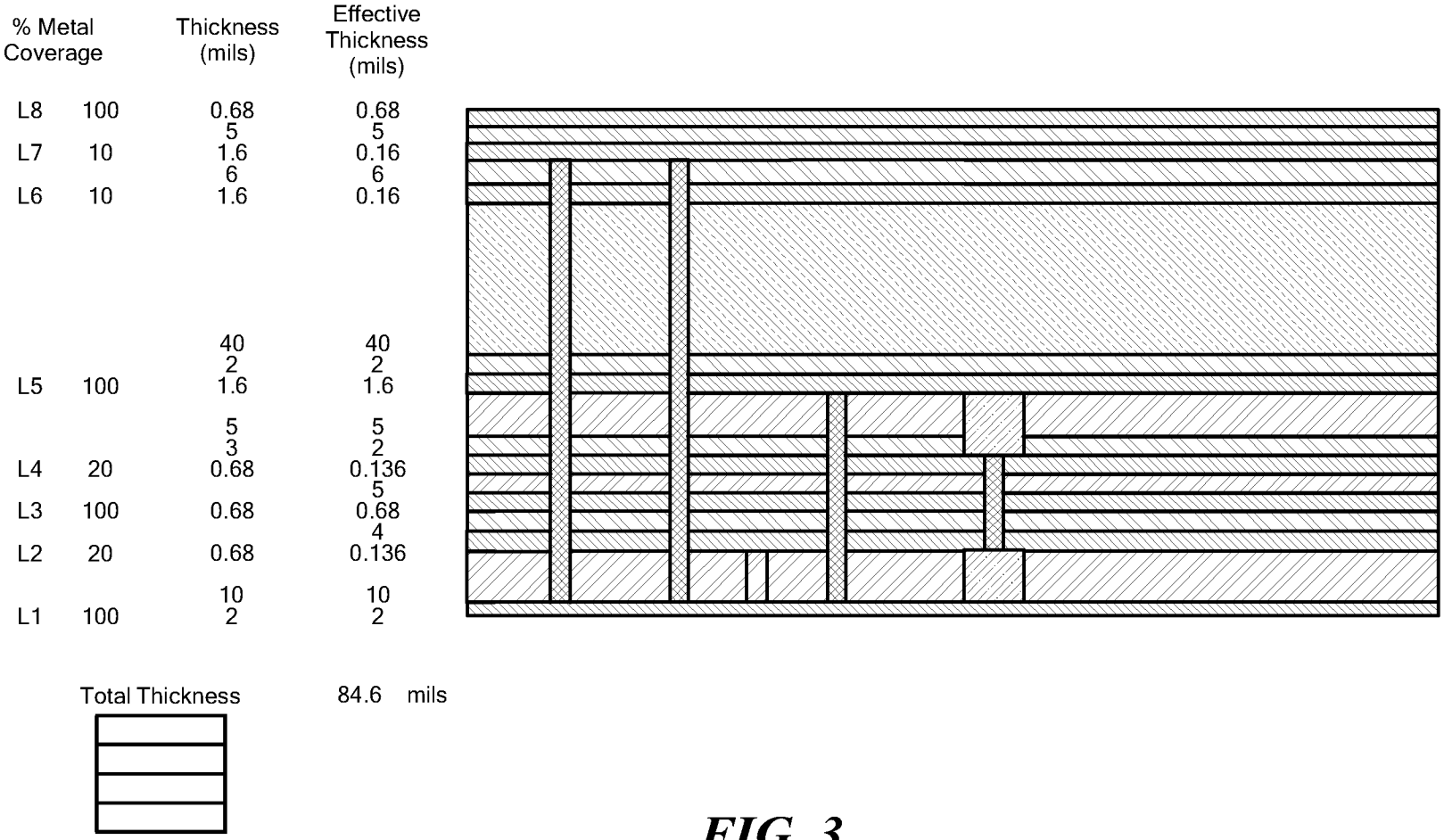
FIG. 3 is a representation of a stack up of an illustrative radiator in accordance with example embodiments of the invention.

As noted above, example embodiments of a radiator can include any practical number of layers. FIG. 3 shows an example PWB stack up for the radiator 100 of FIG. 1A having eight metal layers L1-L8 with illustrative dimensions. As can be seen, vertical vias extend from the layer L1 having the ground plane to the layer L7 having the dipole arms.

Figure 4:
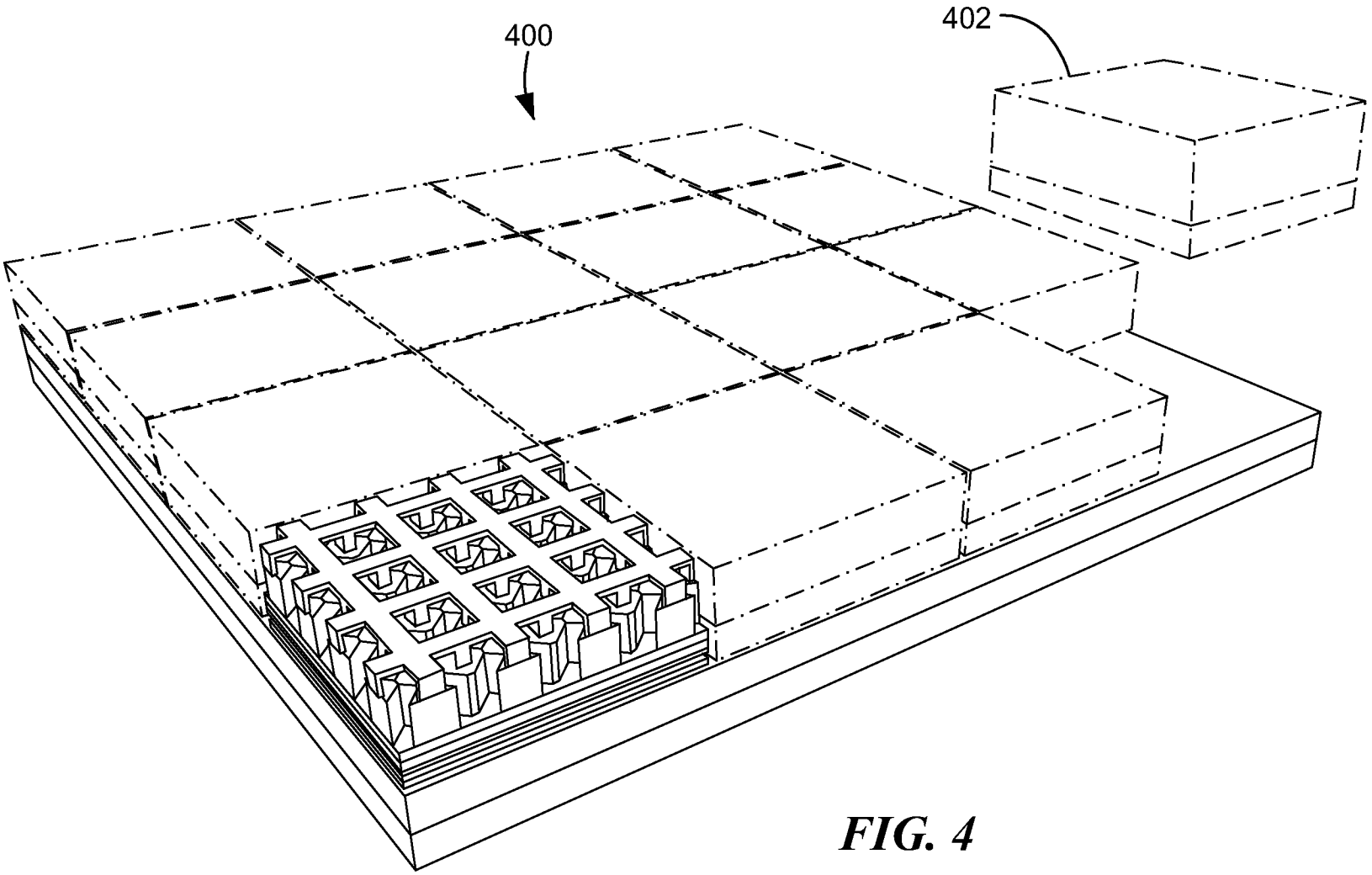
FIG. 4 is a perspective view of an array having radiator elements in accordance with example embodiments of the invention.

FIG. 4 shows an example array 400 having example radiator embodiments described above with a tile or sub-array 402 of radiators shown detached from the array. It is understood that embodiments of the wideband dual differential radiators can be used in wide variety of antenna arrays. These embodiments allow for tiling of smaller arrays that produce modular building blocks to produce larger arrays up to the size required to meet system specifications.

Figure 5:
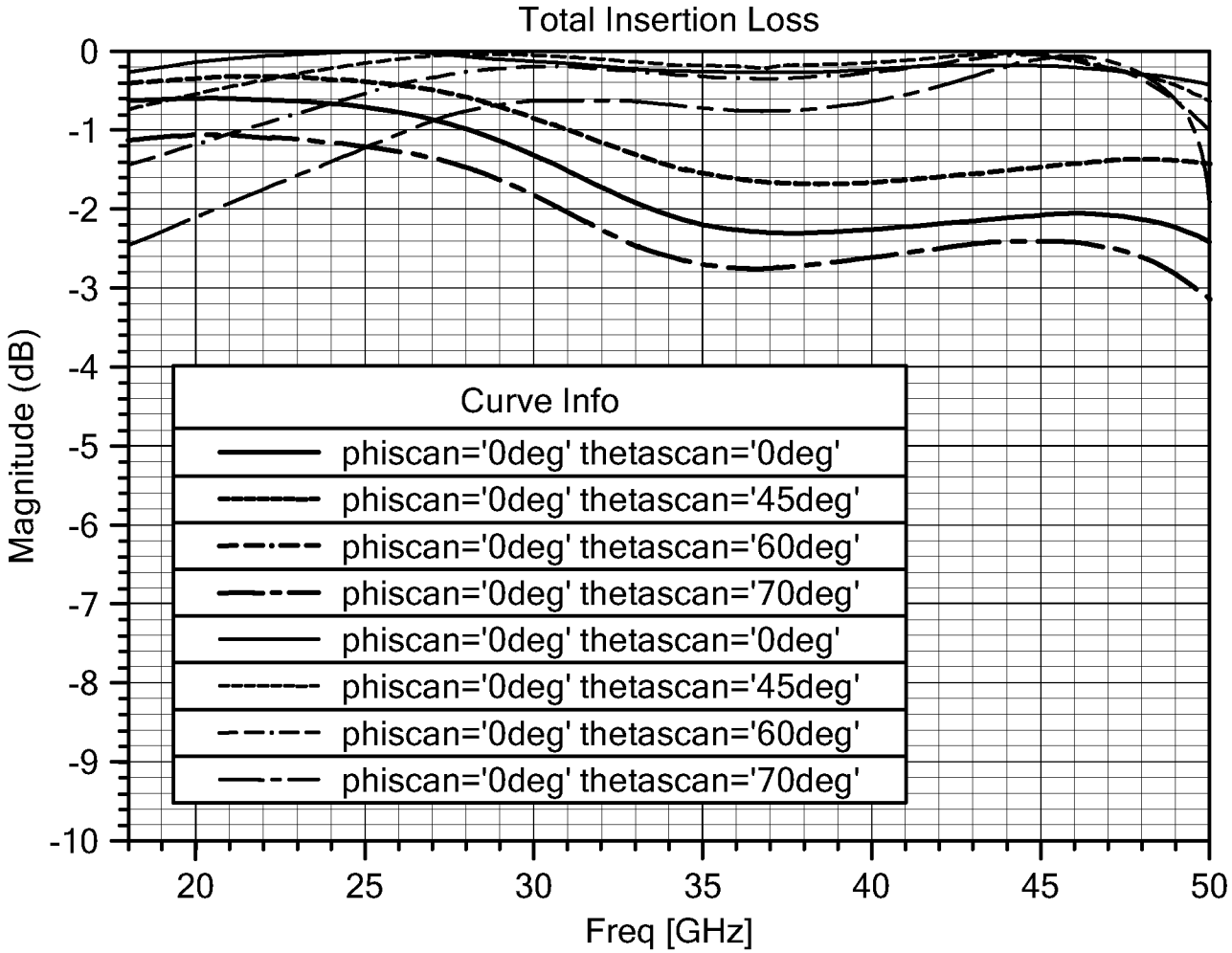
FIG. 5 is a graphical representation of insertion loss performance for an illustrative radiator in accordance with example embodiments of the invention.

FIG. 5 shows example insertion loss performance in magnitude over frequency from 18 GHz to 50 GHz for an example radiator embodiment. Waveforms are shown for ($\varphi$, $\theta$) in the E-plane (solid) and H-plane (dashed). The radiator is modeled as part of an infinite array where $\varphi$ represents the azimuth angle and $\theta$ represents the elevation angle. As can be seen, the insertion loss performance is superior to that of other conventional single ended radiators at these frequencies. Better than 3 dB insertion loss is maintain over both E- and H-plane scan from 18-50 GHz out to 70 degrees.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A current loop radiator, comprising:

a first dipole pair comprising first and second dipole arms;

a second dipole pair comprising third and fourth dipole arms;

a first differential conductor pair having first and second conductors configured to provide a first pair of differential signals to the first and second dipole arms; and a second differential conductor pair having third and fourth conductors configured to provide a second pair of differential signals to the third and fourth dipole arms, wherein the first, second, third, and fourth dipole arms have a coincident phase center.

2. The radiator according to claim 1, further including respective conductive plates capacitively coupled with each of the first, second, third, and fourth dipole arms.

3. The radiator according to claim 2, further including respective ground plates adjacent each of the first, second, third and fourth dipole arms.

4. The radiator according to claim 1, wherein a radiator layer includes the first, second, third, and fourth dipole arms, the conductive plates and the ground plates.

5. The radiator according to claim 4, wherein a feed layer is adjacent the radiator layer, wherein the first and second conductors of the first differential conductor pair extend from the feed layer to the first and second dipole arms.

6. The radiator according to claim 5, wherein the first and second conductors of the first differential conductor pair comprise vias.

7. The radiator according to claim 6, wherein the third and fourth conductors of the second differential conductor pair comprise vias.

8. The radiator according to claim 5, further including a cavity formed in at least a portion of the feed layer.

9. The radiator according to claim 8, wherein the cavity is cylindrical and filled with air.

10. The radiator according to claim 9, wherein the cavity is below the first, second, third and fourth conductors.

11. The radiator according to claim 1, further including a wide-angle impedance matching (WAIM) layer disposed on the radiator over the first and second dipole pairs.

12. The radiator according to claim 1, wherein the radiator and the WAIM layer together have a total depth of less 0.1 inch at 50 GHz.

13. The radiator according to claim 1, wherein the radiator consists of printed wiring board (PWB) materials.

14. A method, comprising:

employing a first dipole pair comprising first and second dipole arms;

employing a second dipole pair comprising third and fourth dipole arms;

employing a first differential conductor pair having first and second conductors for providing a first pair of differential signals to the first and second dipole arms; and employing a second differential conductor pair having third and fourth conductors for providing a second pair of differential signals to the third and fourth dipole arms, wherein the first, second, third, and fourth dipole arms have a coincident phase center.

15. The method according to claim 14, further including employing respective conductive plates capacitively coupled with each of the first, second, third, and fourth dipole arms.

16. The method according to claim 15 further including employing respective ground plates adjacent each of the first, second, third and fourth dipole arms.

17. The method according to claim 16, wherein a radiator layer includes the first, second, third, and fourth dipole arms, the conductive plates and the ground plates.

18. The radiator according to claim 17, wherein a feed layer is adjacent the radiator layer, wherein the first and second conductors of the first differential conductor pair extend from the feed layer to the first and second dipole arms.

19. A current loop radiator, comprising:

a signal receiving means for receiving signals via an air interface;

a first differential conductor means comprising first and second dipole arms for providing a first pair of differential signals to the signal receiving means; and a second differential conductor means comprising third and fourth dipole arms for providing a second pair of differential signals to the signal receiving means, wherein the first, second, third, and fourth dipole arms have a coincident phase center.

* * * * *